US005369971A

United States Patent [19]

Sheppard

[11] Patent Number: 5,369,971

[45] Date of Patent: Dec. 6, 1994

[54] DEAD BOLT PASS KEY LOCK

[76] Inventor: Harold A. Sheppard, P.O. Box 1401, Inola, Okla. 74036

[21] Appl. No.: 88,977

[22] Filed: Jul. 9, 1993

[51] Int. Cl.[5] ..... E05B 13/02

[52] U.S. Cl. ..... 70/416; 70/452; 70/461

[58] Field of Search ..... 70/447, 416, 461, 417, 70/455, 452, 429

[56] References Cited

U.S. PATENT DOCUMENTS

| | | | |
|---|---|---|---|
| 1,700,351 | 1/1929 | Lanes | 70/416 |
| 3,423,974 | 1/1969 | Bernsley | 70/417 |
| 3,748,882 | 7/1973 | Dusault, Jr. et al. | 70/447 |
| 4,044,579 | 8/1977 | Le Bel | 70/461 |
| 5,000,498 | 3/1991 | Upchurch | 70/416 |
| 5,193,373 | 3/1993 | Hunt | 70/416 |
| 5,313,812 | 5/1994 | Eklund et al. | 70/416 |

FOREIGN PATENT DOCUMENTS

| | | | |
|---|---|---|---|
| 930021 | 1/1948 | France | 70/416 |
| 372457 | 5/1932 | United Kingdom | 70/416 |

*Primary Examiner*—Peter M. Cuomo
*Assistant Examiner*—Darnell M. Boucher
*Attorney, Agent, or Firm*—Robert K. Rhea

[57] ABSTRACT

Pass key entry of a space closed by a dead bolt equipped lock door is prohibited by a dead bolt operating knob enclosing housing pivotally mounted to the inside surface of the door adjacent the dead bolt operating knob. The dead bolt knob enclosing housing is moved to door locked position or unlocked position by the occupant of the space.

5 Claims, 2 Drawing Sheets

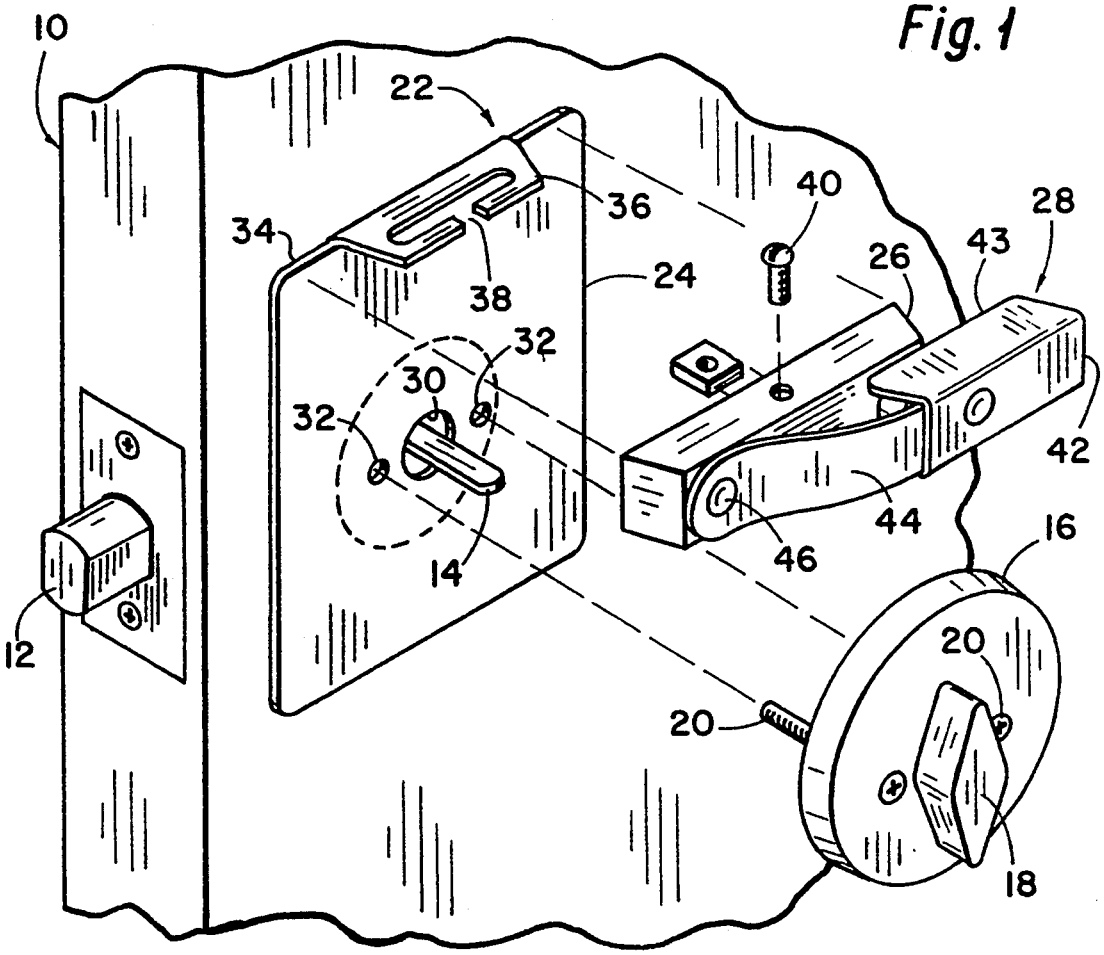
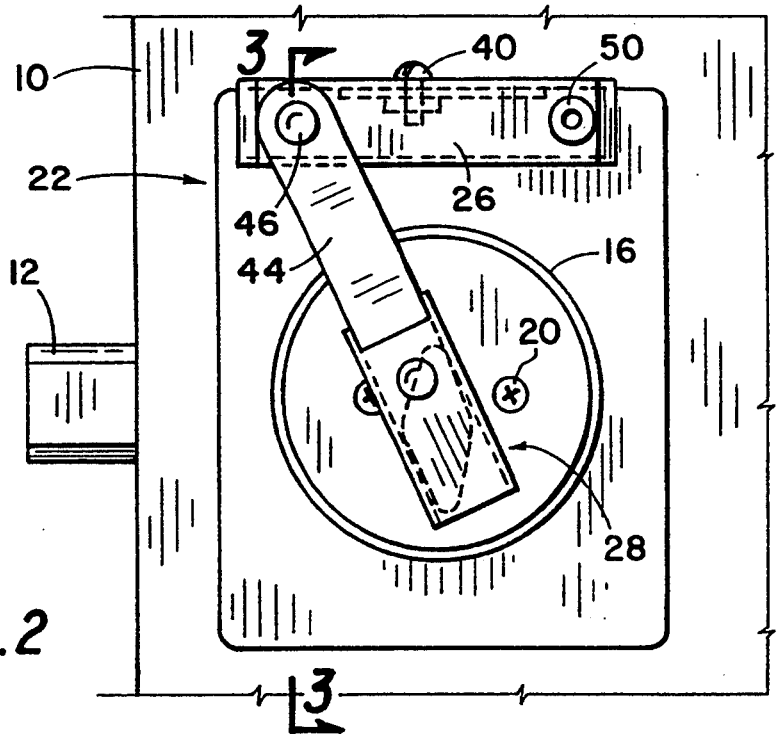
Fig. 2

DEAD BOLT PASS KEY LOCK

BACKGROUND OF THE INVENTION

This invention relates to dead bolt locks and more particularly to a device preventing pass key retraction of a dead bolt.

1. Field of the Invention

Motels, apartments and the like are customarily provided with dead bolts for security of the occupants against unauthorized entry of the premises.

However, the owner and maintenance personnel are also customarily provided with a pass key permitting them to enter the respective room or suite.

Occasionally the pass key or a duplicate thereof is obtained by unauthorized persons who may then gain entry to the premises while occupied by a customer or a renter.

This invention provides a manually manipulated locking arm member which substantially envelops the dead bolt operating knob on the inside of an entry door to prevent angular rotation of the knob and withdrawing the dead bolt by the use of a pass key.

2. Description of the Prior Art

I am not aware of any patent which discloses immobilizing the knob of a dead bolt lock to prevent unlocking a dead bolt lock by a key.

SUMMARY OF THE INVENTION

A planar mounting plate is interposed between the surface of the door and the dead bolt operating knob and held in place by the dead bolt face plate attaching screws. The upper limit of the mounting plate is provided with an overhanging lip for attaching a box-like bracket thereto.

A channel housing dimensioned for closely straddling the manually operated dead bolt knob, is connected with one end of a flexible locking arm pivotally connected at its other end to one end portion of the bracket for swinging movement of the knob channel housing toward and away from the door and vertical pivoting movement with the arm about its horizontal connection with the bracket.

In dead bolt door unlocked position, the locking arm and housing is generally horizontally disposed adjacent the door, and when in dead bolt locked position, the housing is disposed in a dead bolt operating knob substantially surrounding position.

The principal object of this invention is to provide a manually operated device for security and privacy of an occupant by securing the knob of a dead bolt lock in a door locked position against withdrawal of the dead bolt by the use of a pass key.

BRIEF DESCRIPTION OF THE DRAWINGS

FIG. 1 is an exploded perspective view of the device mounted on a fragment of a right hand swing open dead bolt equipped door;

FIG. 2 is an elevational view of the device when in dead bolt door locked position;

DESCRIPTION OF THE PREFERRED EMBODIMENTS

Figure 5:
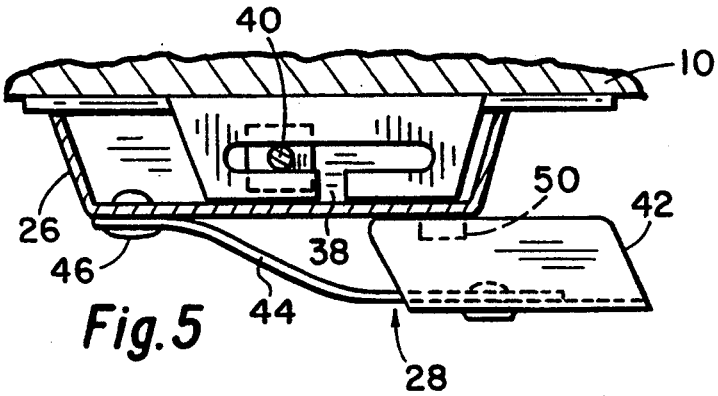
FIG. 5 is a horizontal sectional view, partially in elevation, taken substantially along the line 5—5 of FIG. 4; and, FIG. 6 is an elevational view similar to FIG. 2 illustrating the position of the device when used on a left hand swing open door.

Like characters of reference designate like parts in those figures of the drawings in which they occur.

In the drawings:

The reference numeral 10 indicates a fragment of a residential door equipped with a conventional dead bolt lock as indicated by the thrown dead bolt 12.

As is conventional, the dead bolt 12 is thrown or withdrawn by a tongue member 14 extending from a key face plate, not shown, and centrally entering a knob face plate 16 and knob 18. The tongue member 14 is angularly rotated about its longitudinal axis by a dead bolt key or manually angularly rotating the knob 18 on the inner dead bolt face plate 16. The dead bolt face plate 16 being secured to the door and the dead bolt key face plate by screws 20.

Figure 4:
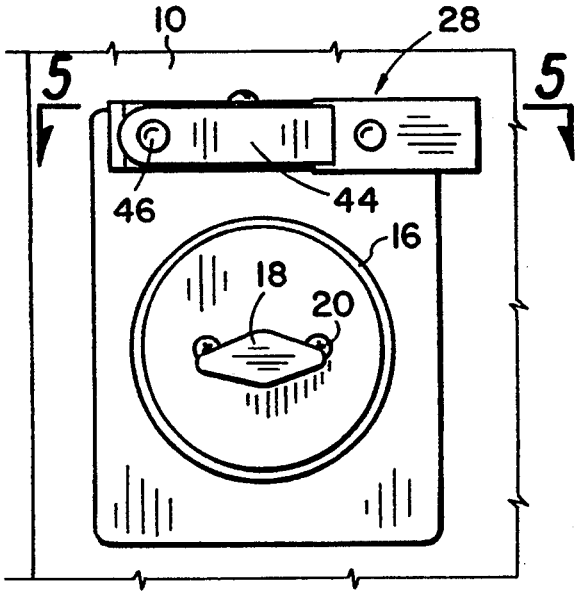
FIG. 4 is an elevational view similar to FIG. 2 illustrating the relative position of the device in dead bolt door unlocked position.
Figure 3:
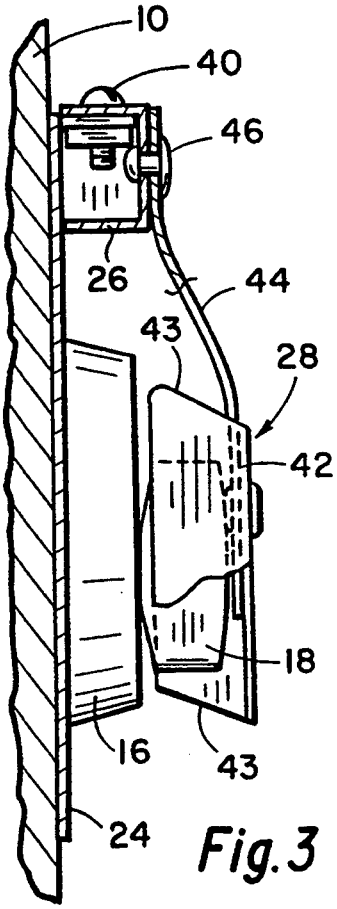
FIG. 3 is an elevational view, partially in elevation, taken substantially along the 3—3 of FIG. 2.

The periphery of the dead bolt operating knob 18 is substantially diamond shaped in general configuration having diagonally opposite parallel surfaces and having a thickness approximating the dimension of its minor axis and in the dead bolt thrown position its major axis is disposed substantially vertical, and in the dead bolt withdrawn position, its major axis is substantially horizontal, as illustrated by FIG. 4.

The above description is substantially conventional with single lock dead bolts and is set forth to show the combination with which the present invention is designed to be used.

The reference numeral 22 indicates the locking device as a whole which principally comprises a mounting plate 24, a box-like bracket 26 and locking arm means 28.

The mounting plate 24 is planar and generally rectangular in the example shown and is flatly interposed between the inner surface of the door 10 and the dead bolt lock face plate 16. The plate is provided with a central aperture 30 for receiving the dead bolt actuating tongue 14.

The plate is also apertured, as at 32, for passage of the screws 20. The plate 24 is further provided with a laterally projecting overhanging lip 36 which is T-slotted, as at 38, for receiving a bolt 40 mounting the box bracket 26 on the lip 36. The T-shaped slot 38 permits longitudinal sliding movement of the bracket 26 relative to the lip 36, for the reasons believed presently apparent.

The locking arm means 28 comprises an elongated channel-like housing 42 having legs 43 spaced-apart a dimension to straddle opposing parallel surfaces and substantially enclose the dead bolt knob 18 when positioned thereover, as presently explained.

One end portion of the housing 42 is secured as by riveting it to one end portion of a generally flat resilient arm 44 in turn connected at its other end portion by a pin or rivet 46 to one end portion of the box bracket 26 for vertical pivoting movement of the locking arm means 28 about the horizontal axis of the rivet 46.

Operation

Assuming the device 22 has been installed on a door, as described hereinabove, the locking arm means 28 is normally disposed horizontally, as illustrated by FIGS. 1 and 4, and the housing 42 is maintained in this position by its legs 43 straddling a pin 50 on the end portion of the bracket 26 opposite the rivet 46.

When the dead bolt 12 has been thrown by angularly rotating the knob 18 the locking arm 28 is manually moved horizontally outward from the door by the resilience of the arm 44 and the arm and housing is angularly rotated downwardly and released to overlie the position of the knob 18 with the channel legs 43 disposed adjacent respective parallel edges of the diamond shape of the knob 18, thus, locking the knob against angular rotation by the tongue member 14 by a dead bolt key to withdraw the dead bolt 12.

The locking arm means 28 is removed from the knob 18 by flexing the spring arm outwardly opposite the door and vertically pivoting the arm parallel with the box bracket 26, the housing legs 43 again straddling the pin 50.

Figure 6:
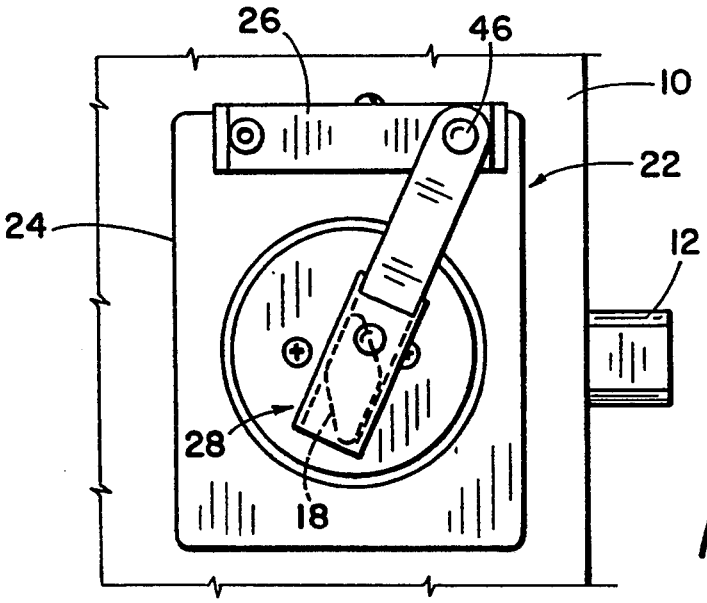

In mounting the device 22 on a left hand open swing door, as illustrated by FIG. 6, the box bracket 26 is simply inverted and similarly connected with the lip 36 in which the pivotal mounting of the spring arm 44 by the rivet 46 permits the channel housing 42 to similarly straddle opposing parallel surfaces of the knob 18 when the arm means 28 is in the knob locked position.

It seems obvious to omit the plate 24 and bracket 26 and pivotally connect the arm means 28 to the door 10, as by a screw or the like, not shown, in place of the rivet 46 if marring the door surface is not a consideration.

Obviously the invention is susceptible to changes or alterations without defeating its practicability. Therefore, I do not wish to be confined to the preferred embodiment shown in the drawings and described herein.

I claim:

1. In a door having a key operated dead bolt lock including an elongated angularly rotatable knob having diagonally opposite parallel surfaces for throwing and withdrawing the dead bolt, the improvement comprising:

a mounting plate interposed between the knob and the door;

a channel housing for straddling said diagonally opposite parallel surfaces and immobilizing said knob against key induced angular rotation when said dead bolt is in a door locked position; and, a resilient arm secured at one end portion to said housing and pivotally connected at its other end portion with said plate for simultaneous pivoting movement of said housing toward and away from the adjacent surface of the door and laterally about the axis of its pivotal connection in a plane parallel with the adjacent surface of the door toward and away from said knob.

2. The combination according to claim 1 and further including:

a bracket interposed between the end portion of said arm opposite said housing and said plate and moveable relative to the plate for adjusting the position of said arm and said housing relative to the dead bolt knob.

3. In a dwelling door having a key operated dead bolt lock including an angularly rotatable knob having longitudinally extending opposite parallel surfaces defining a length at least greater than its width for throwing and withdrawing the dead bolt, the improvement comprising:

a channel housing for straddling said opposite parallel surfaces and immobilizing said knob against key induced angular rotation when said dead bolt is in a door locked position; and, a resilient arm interposed between said housing and pivotally connected with said door for simultaneous pivoting movement of said housing toward and away from the adjacent surface of the door and laterally about the axis of its pivotal connection in a plane parallel with the adjacent surface of the door toward and away from said knob.

4. In a dwelling door having a key operated dead bolt lock including an angularly rotatable knob having longitudinally extending opposite surfaces defining a length at least greater than its width for throwing and withdrawing the dead bolt, the improvement comprising:

a mounting plate interposed between the knob and the door;

a channel housing for straddling said opposite knob surfaces and immobilizing said knob against key induced angular rotation when said dead bolt is in a door locked position;

resilient arm means interposed between said housing and said plate and pivotally connected with said plate for pivoting movement of said housing toward and away from the adjacent surface of the door and laterally about the axis of its pivotal connection in a plane parallel with the adjacent surface of the door toward and away from said knob, and, a bracket interposed between the end portion of said arm opposite said housing and said plate end moveable relative to the plate for adjusting the position of said arm means and said housing relative to the dead bolt knob.

5. The combination according to claim 4 in which said arm means includes:

a resilient arm normally biasing said housing toward the door.

* * * * *